United States Patent [19]

Okuno

[11] 4,412,115

[45] Oct. 25, 1983

[54] CIRCUIT INTERRUPTER

[75] Inventor: Michiharu Okuno, Hyogo, Japan

[73] Assignee: Mitsubishi Denki Kabushiki Kaisha, Tokyo, Japan

[21] Appl. No.: 238,900

[22] Filed: Feb. 27, 1981

[30] Foreign Application Priority Data

Feb. 28, 1980 [JP] Japan ..... 55-26079[U]

[51] Int. Cl.[3] ..... H01H 33/88

[52] U.S. Cl. ..... 200/148 A; 200/150 G

[58] Field of Search ..... 200/148 R, 148 A, 148 B, 200/148 C, 148 D, 148 E, 148 F, 148 G, 148 H, 148 J, 148 BV, 150 G

[56] References Cited

U.S. PATENT DOCUMENTS 4,276,456 6/1981 Cromer et al. ..... 200/150 G X

*Primary Examiner*—Thomas J. Kozma
*Assistant Examiner*—Morris Ginsburg
*Attorney, Agent, or Firm*—Sughrue, Mion, Zinn, Macpeak and Seas

[57] ABSTRACT

A puffer type circuit interrupter in which fingershaped arcing contacts are provided with a large cooling effect by gas which is provided to blow out the arc at the time of an interruption operation. One of a pair of arcing contacts, which are connected to respective output terminals, is provided with a plurality of fingers designed to mate with the other of the arcing contacts. The fingers are attached to a puffer cylinder which has formed in it passageways for directing gas compressed within the cylinder onto the fingers. Inside the fingers is positioned a cylindrical gas guide which, together with a portion of the cylinder which may be a piston rod, directs the flow of air over the fingers in such a manner that the gas passes substantially completely over the fingers before reaching the arc. With this construction, the gas passing the fingers is not heated and hence the amount of metal vaporized from the fingers is quite small.

12 Claims, 7 Drawing Figures

CIRCUIT INTERRUPTER

BACKGROUND OF THE INVENTION

1. Field of the Invention

This invention relates to improved circuit interrupters. More particularly, the invention relates to a puffer type gas circuit breaker in which a flow of gas is created between an arcing contact and a nozzle which blows against an arc generated between a movable arcing contact and a stationary arcing contact thereby to extinguish the arc. Yet more specifically, the invention relates to improved arcing contacts and gas passage forming members provided in the vicinity of the arcing contact.

2. Description of the Prior Art

In a puffer type gas circuit breaker, the pressure of the gas in the puffer cylinder is increased by the utilization of the principle of a bellows so that a flow of gas is created in the gas passageway between the movable arcing contact and the nozzle which blows against an electrical arc generated between the movable arcing contact and the stationary contact thereby to extinguish the arc.

A variety of puffer type gas circuit breakers are available. One example of a conventional puffer type gas circuit breakers is as shown in FIGS. 1 and 2. As is seen in FIGS. 1 and 2, the gas, for example, air or $SF_6$ gas, passes through a gas passageway 75 between a nozzle 10 and a gas guide 23 and then is directed against an electric arc 25 which is generated between a finger-shaped movable arcing contact 7 and a stationary arcing contact 2. As is apparent from FIGS. 1 and 2, in the conventional puffer type gas circuit breaker, the gas which is not heated by the arc yet is not substantially applied to the movable arcing contact 7; that is, the gas heated by the arc is applied to the movable arcing contact 7 thereby increasing the temperature of the contact 7. Moreover, in this structure gas guide 23 is in the form of a cylinder made of an insulating material. Accordingly, it necessarily has a large wall thickness and therefore the gas guide 23 is liable to disturb the flow of gas which is applied to the arc.

SUMMARY OF THE INVENTION

Accordingly, a first object of the invention is to provide an improved circuit interrupter in which the finger-shaped arcing contact provides a large cooling effect and in which the resistance to the flow of gas to the electric arc is small.

A second object of the invention is to prevent the finger-shaped arcing contact from being deformed by an electro-magnetic force which is caused by current flowing therein.

A third object of the invention is to reduce the amount of metal vapor which is created from the finger-shaped arcing contact thereby to minimize the adverse effects of such metal vapor on the interruption efficiency.

A fourth object of the invention is to simplify the construction of the gas guide thereby to permit the gas guide to be manufactured at a low cost.

A fifth object of the invention is to provide an improved circuit interrupter which is made suitable for a high-speedcircuit interruption by reducing the weight of the gas guide.

These, as well as other objects of the invention, are met by a puffer type gas circuit breaker including a pair of terminals, a pair of separable contacts electrically connected to respective ones of the terminals, a pair of arcing contacts electrically connected to respective ones of the terminals with the arcing contacts disposed to be separated from each other after the separation of the separable contacts during an interruption operation wherein at least one of the arcing contacts has a plurality of fingers, a puffer cylinder, a piston fitted slidably in the puffer cylinder for compressing gas in the puffer cylinder in cooperation with the puffer cylinder during the interruption operation to such an extent (that is, to a sufficient pressure) such that the compressed gas is capable of blowing out and arc generated between the arcing contacts, a gas guide provided adjacent the fingers of the arcing contact which defines with the fingers passageways for gas which is blown against the arc with the gas flowing past the fingers prior to reaching the arc. Because the gas is not heated before it passes the fingers, their temperature is not increased thereby reducing the amount of metal which is vaporized from the fingers.

Preferably, all the surfaces of the fingers except for surfaces which confront the gas guide and surfaces of the gas guide which are on the side of the fingers and are defined between the fingers are shaped and disposed to be directly in contact with the gas prior to the gas reaching the arc. In a preferred embodiment, the gas guide is cylindrical and the fingers are arranged at equal intervals around the gas guide. The arcing contacts having the fingers and the gas guide are separable components and the gas guide and arcing contact having the fingers are supportingly mounted on the puffer cylinder. The puffer cylinder should be provided with a plurality of inclined gas discharging holes arranged such that gas compressed in the puffer cylinder blows against the gas guide and end faces of the fingers adjacent to the arc. The gas guide should be electrically conductive. The arcing contact having the fingers is preferably threadably coupled to the puffer cylinder whereby the gas guide is supported on the puffer cylinder while being held between the arcing contact and the puffer cylinder. The gas guide is inserted into the arcing contact having the fingers to form an assembly after which the assembly is threadably coupled to the puffer cylinder.

The foregoing objects and other objects as well as the characteristic features of the invention will become more apparent from the following detailed description and the appended claims when read in conjunction with the accompanying drawings.

DESCRIPTION OF THE PREFERRED EMBODIMENTS

Figure 1:
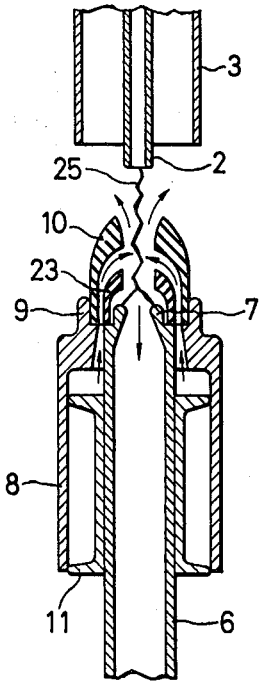
FIG. 1 PRIOR ART
FIG. 1 is a sectional view of the arc extinguishing chamber of a conventional puffer type gas circuit breaker in which an electric arc is generated.
Figure 2:
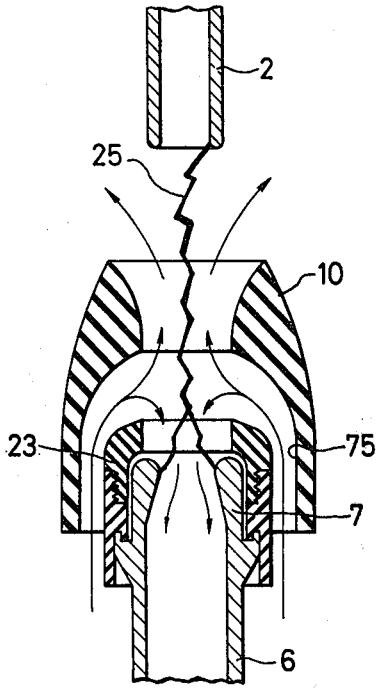
FIG. 2 PRIOR ART
FIG. 2 is an enlarged sectional view of a movable arcing contact and related components shown in FIG. 1.
Figure 3:
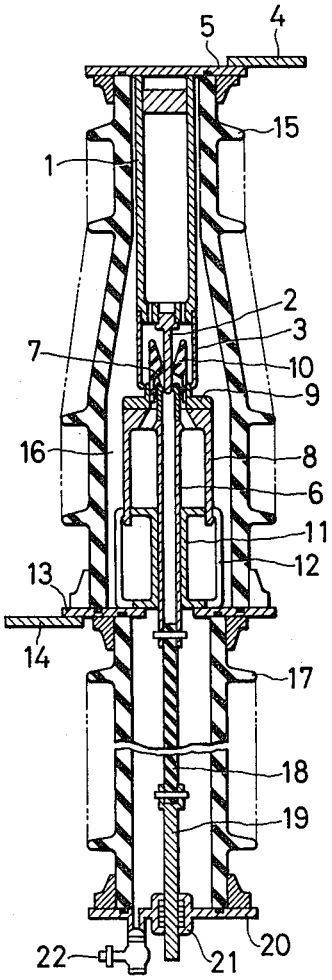
FIG. 3 is a schematic sectional view showing a preferred embodiment of a puffer type gas circuit breaker (with details of components omitted) according to the invention in the closed state.
Figure 4:
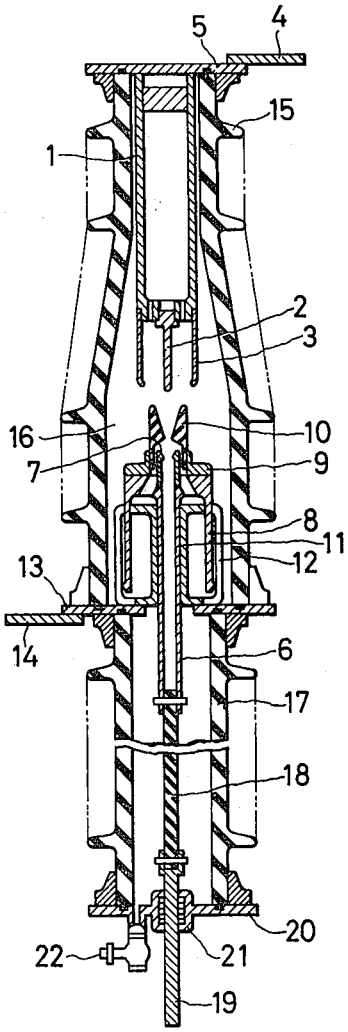
FIG. 4 is a schematic sectional view showing the puffer type gas circuit breaker in FIG. 3 in the open state.

Referring to FIGS. 3 and 4, a stationary arcing contact 2 and a cylinder stationary contact 3 encircling the arcing contact 2 are coaxially fixed to the lower end portion of an electrically conductive contact support 1. The upper end of the contact support 1 is fixed to an upper flange 5 to which an upper terminal 4 is connected. A movable arcing contact 7 (made of an electrically and thermally conductive material such as a copper-chromium alloy) and a cup-shaped electrically conductive puffer cylinder 8 is fixed to the upper end portion of a piston rod 6 made of an electrically conductive tube. As shown in FIG. 3, the movable arcing contact 7 is in contact with the stationary arcing contact 2 and is separated from the stationary arcing contact 2 as shown in FIG. 4. A hollow movable contact 9 is fixed to the upper end portion of the puffer cylinder 8. The movable contact 9 is shown in contact with the stationary contact 3 in FIG. 3 and separated from the contact 3 in FIG. 4.

The lower end portion of a cylindrical movable nozzle 10 is fixed to the inner surface of the above-described movable contact 9. The movable nozzle 10 is made of a heat-resistant insulator such as polytetrafluoroethylene ("Teflon TM"). The nozzle 10 which encircles the stationary arcing contact 2 in FIG. 3 is separated from the contact 2 axially as seen in FIG. 4.

The piston rod 6 is slidably extendable among the axis of a stationary piston 11 which is slidably engaged with the inner surface of the puffer cylinder 8. The upper end portion of a stationary finger contact 12 is maintained slidably in contact with the outer surface of the puffer cylinder 8 while the lower end portion thereof together with the piston 11 is fixed to an electrically conductive lower flange 13 to which a lower terminal 14 is connected. An arc extinguishing chamber 16 is formed inside a cylindrical interrupting porcelain insulator 15. An insulating gas such as air, $SF_6$ gas or the like, is filled in the chamber 16. The upper flange 5 and the lower flange 13 are gas-tightly mounted on the upper end and the lower end, respectively, of the porcelain insulator 15. Furthermore, the lower flange 13 is gas-tightly mounted on a supporting porcelain insulator 17.

An insulating rod 18 has an upper end portion connected to the piston rod 6 and a lower end portion connected to an operating rod 19. The operating rod 19 slidably penetrates a lowest flange 20 through a slide seal 21. The lowest flange is gas-tightly mounted on the supporting porcelain insulator 17. The lower end portion of the operating rod 19 is coupled to an operating mechanism (not shown). A gas valve 22 is mounted on the lowest flange 20 through which is supplied an insulating gas, such as air, $SF_6$ gas, or the like, which flows into the space in the supporting porcelain insulator 17 then into the arc extinguishing chamber 16.

Figure 5:
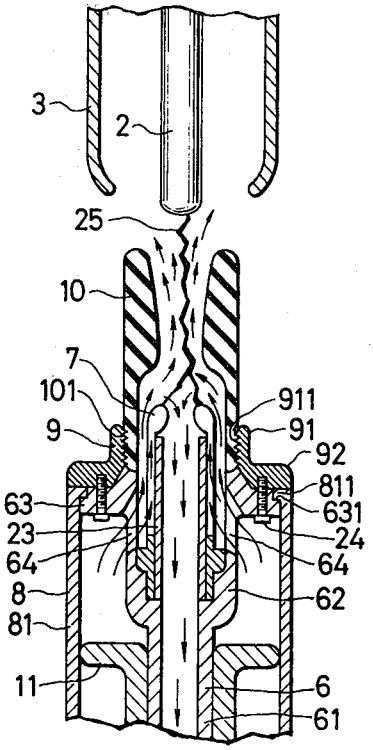
FIG. 5 is an enlarged sectional view showing an arc extinguishing chamber in FIG. 4 in which an electric arc is generated.
Figure 6:
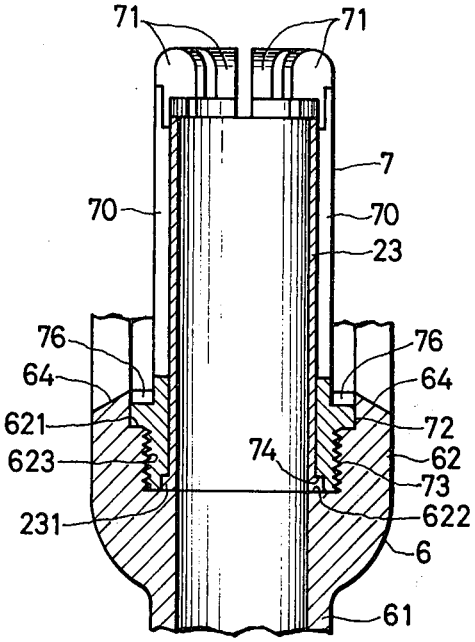
FIG. 6 is an enlarged sectional view showing an arcing contact and related components in FIG. 5.
Figure 7:
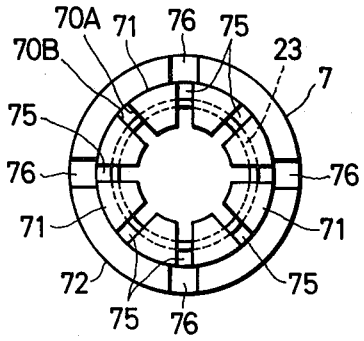
FIG. 7 is a top view of the arcing contact and the gas guide which are shown in FIG. 6.

The construction of the arc extinguishing chamber 16 is illustrated in FIGS. 5 through 7 in more detail. As shown in these figures, a tubular gas guide 23 of copper has a flange portion 231 at the lower end. The piston rod 6 described above is made up of a hollow rod portion 61, a hollow neck portion 62 and a hollow flange portion 63. A first step portion 621, a second step portion 622 and a thread portion 623 are formed in the inner surface of the neck portion 62. Furthermore, a step portion 631 is formed on the flange portion 63. A plurality of gas discharging holes 64 are circumferentially provided in the boundary between the neck portion 62 and the flange portion 63 at equal intervals.

The movable arcing contact 7 is made up of a plurality of fingers 70 of copper-chromium alloy which are arranged annularly around the gas guide 23 at equal intervals, arcing tips 71 of copper-tungsten alloy which are brazed to the ends of the fingers 70, a flange portion 72 the lower surface of which is abutted against the first step portion 621, a thread portion 73 which is formed on the outer surface of the lower end portion of the movable arcing contact 7 and is engaged with the aforementioned thread portion 623, and a step portion 74 which is formed at the lower end portion of the movable arcing contact 7 and is abutted against the upper surface of the flange portion 231.

The outer surface of the gas guide 23, the side surface 70A of each finger 70, and the side surface 70B of adjacent fingers 70 form a gas passageways 75 in the form of conduits. As shown in FIG. 7, eight gas passageways 75 are provided circumferentially at equal intervals. The gas passageways 75 are of equal width W in the circumferential direction and they extend along the finger 70. Recesses 76 are formed in the upper surface of the flange portion 72.

The puffer cylinder 8 is constituted by a cylinder 81 having an annular protruding portion 811, the above-described neck portion 62, and the above-described flange portion 63. The movable contact 9 is made up of a cylindrical protruding portion 91 having a thread portion 911 in its inner surface and a flange portion 92. The movable contact 9 is made of a copper-chromium alloy. The above-described cylinder 81, rod 6 and movable contact 9 are assembled as a unit with screws 24. In the unit thus assembled, the annular protruding portion 811 is fixedly held between the step portion 631 and the flange portion 92. The movable nozzle 10 has a thread portion 101 which is engaged with the above-described thread portion 911.

A method of assembling the above-described various components will be described. The gas guide 23 is inserted into the movable arcing contact 7 through the opening which is opposite to the arcing tips 71 and the flange portion 231 is fitted to the step portion 74 of the movable arcing contact 7. Thereafter, the assembly of the movable arcing contact 7 and the gas guide 23 is inserted into the neck portion 62 of the above-described unit constituted by the rod 6, the cylinder 81 and the movable contact while being turned. The thread portion 623 is engaged with the thread portion 73 so that the assembly and the unit are fixedly coupled to each other. Then, the movable nozzle 10 is mounted on the movable contact 9 by engaging the thread portion 911 with the thread portion 101. The assembly of the movable arcing contact 7 and the gas guide 23 is turned with a jig (not shown) engaged with the recesses 76.

Now, the operation of the circuit interruptor thus constructed will be described.

Referring back to FIG. 3, in the closed state almost all the current flows through the lower terminal 14, the lower flange 13, the stationary finger contact 12, the puffer cylinder 8, the movable contact 9, the stationary contact 3, the contact support 1, the upper flange 5 and the upper terminal 4.

When the operating mechanism (not shown) is operated to trip the circuit breaker from the closed state as shown in FIG. 3, the piston rod 6 is moved downwardly by the operating rod 19 and the insulating rod 18. As the piston rod 6 is moved downwardly, the puffer cylinder 8, the movable contact 9, the movable arcing contact 7 and the movable nozzle 10 are also moved downwardly. As a result, first the movable contact 9 is separated from the stationary contact 3 and then the movable arcing contact 7 is separated from the stationary arcing contact 2. When these arcing contacts 7 and 2 separate from each other, an arc 25 is generated between the contacts 7 and 2 as shown in FIG. 5.

As the puffer cylinder 8 is moved downwardly, the gas in the cylinder 8 is compressed by the stationary piston 11. The gas thus compressed is forced to blow through the plurality of gas discharging holes 64 and the plurality of gas passageways 75 against the arc as shown in FIG. 5 finally extinguishing the arc 25. Thus, the open state as shown in FIG. 4 is reached.

As is apparent from the above description, when the arc 25 starts from the plurality of arcing tips 71, currents flow in the fingers 70 which are coupled to the arcing tips in the same direction. Accordingly, the fingers 70 are forced to come closer to one another by the electromagnetic force. However, the provision of the gas guide 23 prevents the fingers 70 from being bent by the force causing them to come closer to one another. The gas which flows into the plurality of gas passageways 75 is not heated by the arc. Thus, the unheated gas cools all the surfaces of the fingers 70 (except for the contact surfaces thereof which are in contact with the gas guide 23), the outer surface of the gas guide 23 which is not in contact with the fingers 70, and substantially all the surfaces of the arcing tips 71, as well as the gas guide 23 itself. This cooling operation reduces the amount of metal vapor which is created from the arcing tips 71 because of high temperatures and which can adversely affect the interruption characteristic. This gas action also minimizes the softening of the fingers 70 and gas guide 23 which would otherwise be caused by high temperature. Thus, deformation of the fingers 70 and the gas guide 23 due to the electromagnetic force is prevented. Furthermore, the above-described sufficient cooling effect makes it possible to reduce the mechanical strengths of the fingers 70 and the gas guide 23 and accordingly to decrease the weights of the fingers 70 and gas guide 23 which makes them more suitable for high speed interruption. In addition, only the fingers 70 and arcing tips 71 are interposed in the gas passageway which is formed between the outer surface of the gas guide 23 and the inner surfaces of the above-described neck portion 62, flange portion 63 and movable nozzle 10. Accordingly, the total area of the gas passageway is large and the resistance to the flowing gas is low which allows a sufficient amount of gas to act on the arc 25 and accordingly improves the arc extinguishing efficiency.

What is claimed is:

1. A puffer type gas circuit breaker comprising: a pair of terminals; a pair of separable contacts which are electrically connected to respective ones of said terminals; a pair of arcing contacts which are electrically connected to respective ones of said terminals and are disposed to be separated from each other after the separation of said separable contacts at the time of interruption, at least one of said arcing contacts having a plurality of fingers; a puffer cylinder; and a piston fitted slidably in said puffer cylinder for compressing gas in said puffer cylinder in cooperation with said puffer cylinder at the time of interruption to such an extent that at the time of interruption the compressed gas is capable of blowing out an arc generated between said arcing contacts; a gas guide provided inside and adjacent to said fingers of said arcing contact, said gas guide defining with said fingers passageways for gas to be blown against said arc, said gas contacting said fingers prior to reaching said arc.

2. The puffer type gas circuit breaker as claimed in claim 1 in which all surfaces of said fingers except for surfaces thereof which confront said gas guide, and surfaces of said gas guide which are on the side of said fingers and are defined between said fingers are shaped and disposed to be directly in contact with said gas prior to said gas reaching said arc.

3. The puffer type gas circuit breaker as claimed in claim 1 or 2 in which said gas guide is cylindrical and said fingers are arranged at equal intervals around said gas guide.

4. The puffer type gas circuit breaker as claimed in claim 1 or 2 in which said arcing contact having said fingers and said gas guide are separable components.

5. The puffer type gas circuit breaker as claimed in claim 1 in which said gas guide and said arcing contact having said fingers are supportingly mounted on said puffer cylinder.

6. The puffer type gas circuit breaker is claimed in claim 1 or 2 in which said puffer cylinder has a plurality of inclined gas discharging holes arranged such that gas compressed in said puffer cylinder blows against said gas guide and end faces of said fingers which are adjacent to said arc.

7. The puffer type gas circuit breaker as claimed in claim 1 or 2 in which said gas guide is electrically conductive.

8. The puffer type gas circuit breaker as claimed in claim 5 in which said arcing contact having said fingers is threadably coupled to said puffer cylinder whereby said gas guide is supported on said puffer cylinder while being held between said arching contact and said puffer cylinder.

9. The puffer type gas circuit breaker as claimed in claim 8 in which said gas guide is inserted into said arching contact having said fingers to form an assembly and thereafter said assembly is threadably coupled to said puffer cylinder.

10. A puffer type gas circuit breaker comprising: a pair of terminals; a pair of separable contacts which are electrically connected to respective ones of said terminals; a pair of arcing contacts which are electrically connected to respective ones of said terminals and are disposed to be separated from each other after the separation of said separable contacts at the time of interruption, at least one of said arcing contacts having a plurality of fingers; a puffer cylinder; a piston fitted slidably in said puffer cylinder for compressing gas in said puffer cylinder in cooperation with said puffer cylinder during a compression stroke thereof at the time of interruption to such an extent that at the time of interruption the compressed gas is capable of blowing out an arc generated between said arcing contacts, said compressed gas being heated by said arc prior to blowing out said arc;

a gas guide provided adjacent to said fingers of said arcing contact, said gas guide defining with said fingers passageways for gas to be blown against said arc, said gas contacting said fingers prior to reaching said arc;

all surfaces of said fingers except for surfaces thereof which confront said gas guide and surfaces of said gas guide which are on the side of said fingers and are defined between said fingers being shaped and disposed to be directly in contact with said gas prior to said gas reaching said arc;

said gas guide comprising a hollow cylinder; said fingers being arranged at equal intervals around said gas guide, a portion of said heated compressed gas flowing away from said fingers and contacting the inside surface of said hollow cylindrical gas guide;

said arcing contact having said fingers and said gas guide being separable components and being supportingly mounted on said puffer cylinder;

said puffer cylinder having a plurality of inclined gas discharging holes arranged such that gas compressed in said puffer cylinder blows against said gas guide and end surfaces of said fingers which are opposite to said arc; and said gas guide being electrically conductive.

11. The puffer type gas circuit breaker as claimed in claim 1, 2 or 10 further comprising a piston rod coupling said arcing contact having said fingers to said puffer cylinder, said piston rod having an upper portion surrounding at least a lower portion of said fingers with a gas passageway being formed between an outer surface of said fingers and an inner surface of said rod.

12. The puffer type gas circuit breaker as claimed in claim 1, 2 or 10 further comprising a piston rod coupling said arcing contact having said fingers to said puffer cylinder, said piston rod having an upper portion surrounding at least a lower portion of said fingers with a gas passageway being formed between an outer surface of said fingers and an inner surface of said rod, and further comprising a substantially cylindrical movable nozzle having a lower end disposed around an upper portion of said fingers, said movable nozzle being rigidly secured to said puffer cylinder.

* * * * *